US006220906B1

(12) United States Patent
Dubois

(10) Patent No.: US 6,220,906 B1
(45) Date of Patent: Apr. 24, 2001

(54) MARINE PROPULSION ASSEMBLY

(75) Inventor: Neil J. Dubois, Cranston, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/413,056

(22) Filed: Oct. 4, 1999

(51) Int. Cl.[7] ..... B63H 5/10

(52) U.S. Cl. ..... 440/81; 440/72; 440/79; 114/20.1; 114/338; 416/128

(58) Field of Search ..... 440/38, 49, 75, 440/79, 80, 81, 83; 114/337, 338; 416/128, 129

(56) References Cited

U.S. PATENT DOCUMENTS

| | | | | |
|---|---|---|---|---|
| 142,820 | * | 9/1873 | Stevens et al. | 416/220 R |
| D. 325,916 | * | 5/1992 | Lanier | D15/4 |
| 1,295,355 | * | 2/1919 | Myers | 114/20.1 |
| 1,555,043 | * | 9/1925 | Wagner | 416/129 |
| 3,038,307 | * | 6/1962 | Oprecht | 60/39.161 |
| 3,087,553 | * | 4/1963 | Kostyun | 440/87 |
| 5,389,020 | * | 2/1995 | Clark | 440/67 |

FOREIGN PATENT DOCUMENTS

| | | | | |
|---|---|---|---|---|
| 421255 | * | 2/1911 | (FR) | 440/81 |
| 433998 | * | 9/1998 | (FR) | 440/80 |
| 6194 | * | 1/1984 | (JP) | 440/80 |
| 92296 | * | 5/1984 | (JP) | 440/80 |
| 312790 | * | 5/1972 | (SU) | 440/80 |
| 98/38085 | * | 9/1998 | (WO) | 440/79 |

* cited by examiner

*Primary Examiner*—S. Joseph Morano
*Assistant Examiner*—Ajay Vasudeva
(74) *Attorney, Agent, or Firm*—Michael J. McGowan; James M. Kasischke; Prithvi C. Lall

(57) ABSTRACT

A marine propulsion assembly comprises a drive shaft, a first propeller fixed to the drive shaft and turnable therewith in a first direction, an annular array of gear teeth disposed on the first propeller and turnable therewith, a second propeller aligned with the first propeller, and an annular array of gear teeth disposed on the second propeller. Bevel gears are disposed between the first and second propellers and engaged with the first and second annular arrays of gear teeth. The bevel gears transmit rotation of the first propeller to the second propeller, such that the second propeller turns in an opposite direction relative to the first propeller.

3 Claims, 4 Drawing Sheets

MARINE PROPULSION ASSEMBLY

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The invention relates to marine propulsion systems including drive shafts and propellers, and is directed more particularly to a marine propulsion system in which there is only a single drive shaft and two counter rotatable propellers.

(2) Description of the Prior Art

The use of counter-rotating propellers in marine propulsion systems is known. In particular, and referring to FIG. 1, such arrangements of propellers 10, 12 have found utility in torpedoes and unmanned undersea vehicles 14, and are favored in view of their efficiency, quiet operation, and the fact that they are torque balanced.

Known systems, as shown in FIG. 2, include two propeller drive shafts 16, 18, one for each propeller. Inasmuch as the two propellers 10, 12 typically are in axial alignment with each other, one of the drive shafts 18 is nested inside the other 16. A drive source 20, such as a motor or engine, drives the two shafts 16, 18. Bearings 22 are required between the two shafts, as well as between the outer shaft 16 and the vehicle body, or other support structure 24. Seals (not shown) are also required between the two shafts.

When an electric motor is used for the drive source 20, the use of two counter-rotating shafts requires a relatively complex motor, typically requiring a hole through the motor in which the inner shaft is disposed, or a secondary outer case which allows the field to rotate as well as the outer shaft.

There is a need for a simpler structure with respect to the drive shaft component of the assembly and a structure which permits use of an ordinary electric motor.

SUMMARY OF THE INVENTION

An object of the invention is to provide a marine propulsion assembly wherein two propellers rotate in opposite directions and are driven by a single drive shaft.

With the above and other objects in view, as will hereinafter appear, a feature of the present invention is the provision of a marine propulsion assembly which includes a drive shaft, a first propeller fixed to the drive shaft and turnable therewith in a first direction, and an annular array of gear teeth disposed on the first propeller and turnable therewith. The assembly further includes a second propeller aligned with the first propeller, and an annular array of gear teeth disposed on the second propeller. Bevel gears are disposed between the first and second propellers and are each provided with a single array of teeth engaged with the first and second annular arrays of gear teeth. The bevel gears transmit rotation of the drive shaft and the first propeller to the second propeller, such that the second propeller turns in an opposite direction relative to the first propeller.

The above and other features of the invention, including various novel details of construction and combinations of parts, will now be more particularly described with reference to the accompanying drawings and pointed out in the claims.

It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which are shown illustrative embodiments of the invention, from which its novel features and advantages will be apparent, wherein corresponding reference characters indicate corresponding parts throughout the several views of the drawings and wherein.

DESCRIPTION OF THE PREFERRED EMBODIMENT

Figure 1:
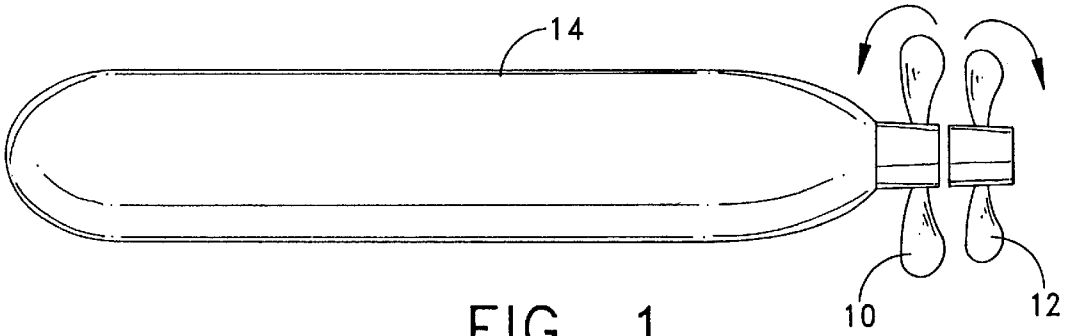
FIG. 1 (PRIOR ART)
FIG. 1 is a side elevational view of a prior art underwater vehicle having counter-rotating propellers.
Figure 2:
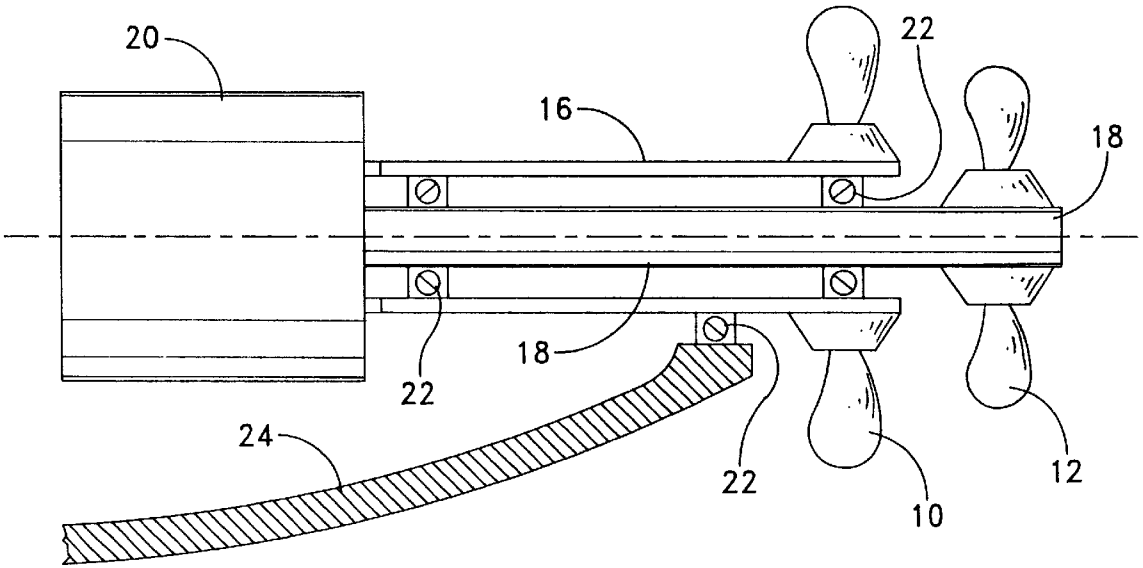
FIG. 2 (PRIOR ART)
FIG. 2 is a diagrammatic illustration of a prior art propulsion assembly.
Figure 3:
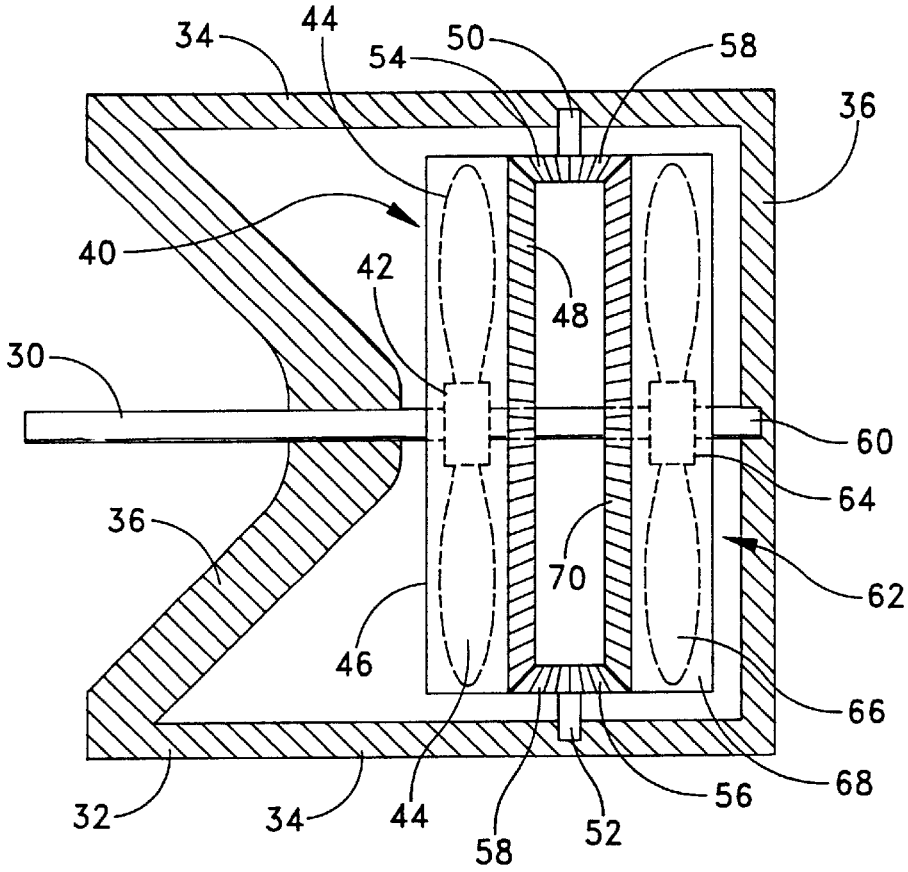
FIG. 3 is a diagrammatic view, partly in section and partly in elevation, of one form of propulsion assembly illustrative of an embodiment of the invention.
Figure 4:
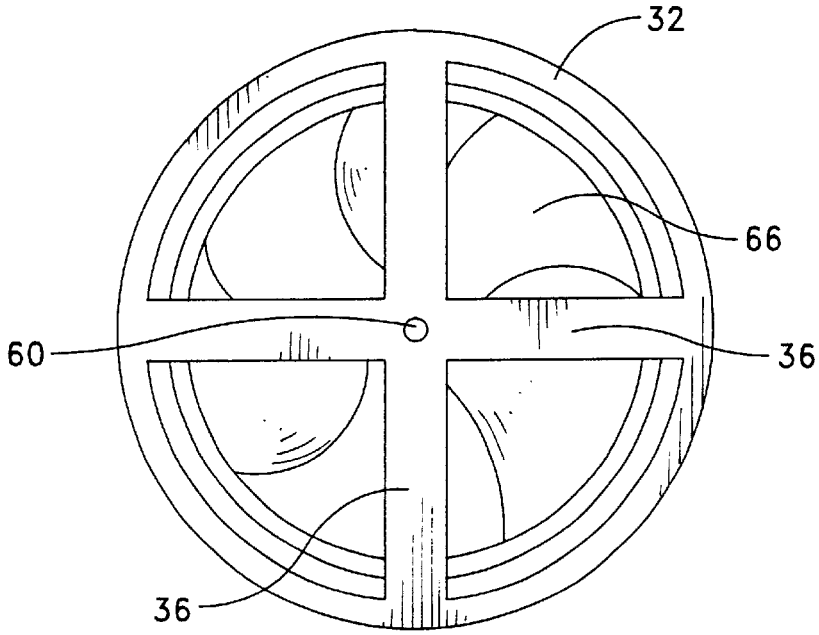
FIG. 4 is an end view of the assembly of FIG. 3.
Figure 5:
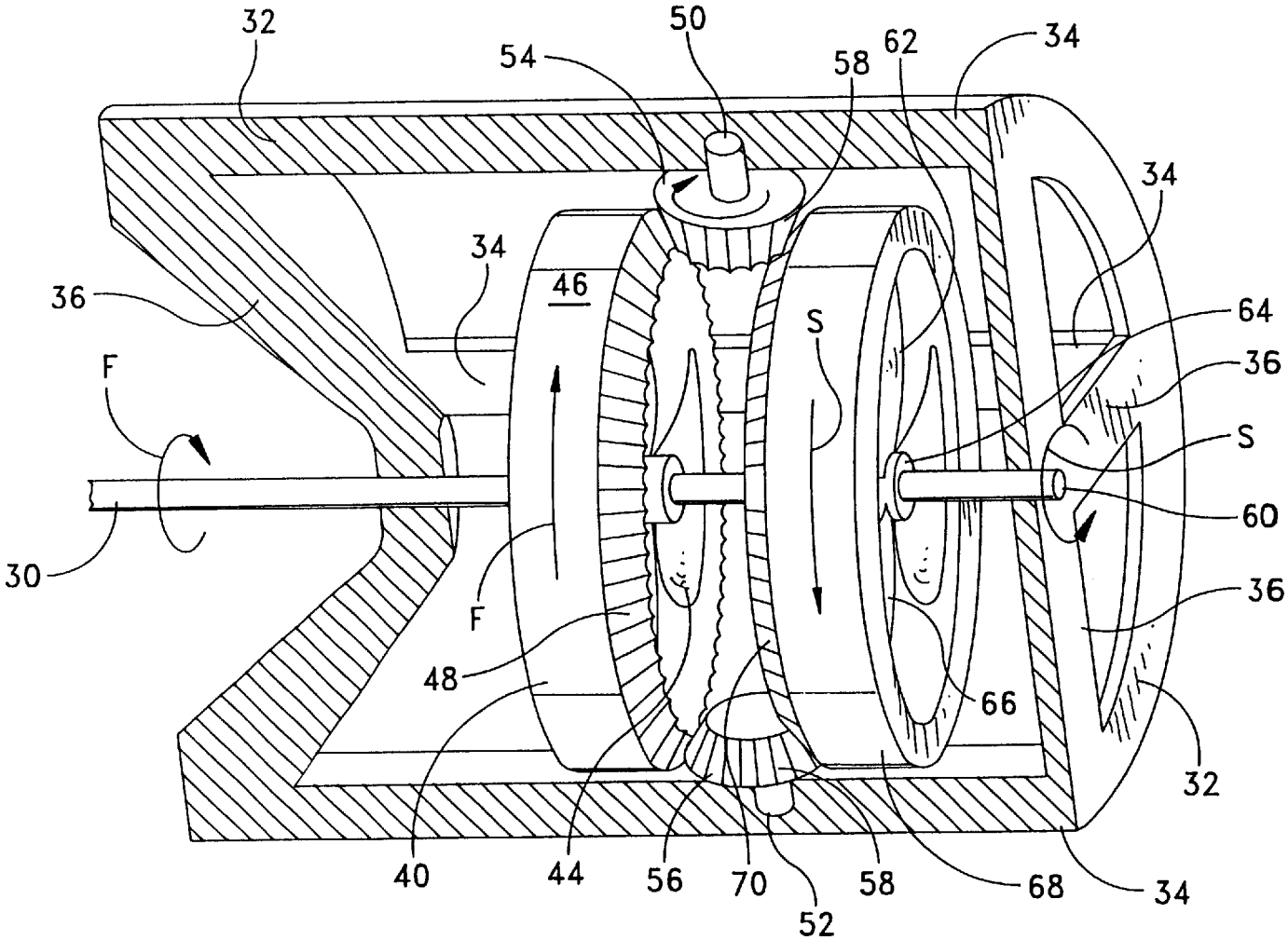
FIG. 5 is a perspective and partly sectional view of the assembly of FIGS. 3 and 4.

Referring to FIGS. 3–5, it will be seen that an illustrative embodiment of the invention includes a drive shaft 30 rotatable by a drive source 20 (FIG. 2). The drive shaft 30 extends into a rigid cage 32 which includes fore-and-aft struts 34 and athwartships struts 36. Water readily flows through the cage 32.

Fixed to the drive shaft 30 is a first propeller 40 including a first propeller hub 42 to which are fixed propeller blades 44. The outboard tips of the propeller blades 44 are fixed to a first ring 46 having thereon an annular array of gear teeth 48.

Rotatably mounted on opposed struts 34 are spindles 50, 52 having fixed thereon bevel gears 54, 56, respectively. The bevel gears 54, 56 are each provided with a single array of gear teeth 58, which are complementary to, and engaged with, the first propeller gear teeth 48.

A shaft 60 is rotatably mounted in the first propeller hub 42 and in athwartships struts 36. Fixed to the shaft 60 is a second propeller 62 including a second propeller hub 64 to which are fixed propeller blades 66. The outboard tips of the propeller blades 66 are fixed to a second ring 68 having thereon an annular array of gear teeth 70. The gear teeth 70 are complementary to, and engaged with, the bevel gear teeth 58.

Referring to FIG. 5, it will be seen that rotation of the drive shaft 30 in a first direction F causes rotation of the first propeller 40 in the same direction. Rotative movement of the first propeller gear teeth 48 induces rotation of the bevel gears 54, 56 with which the gear teeth 48 are meshed. Rotation of the bevel gears 54, 56, meshed also with the gear teeth 70 of the second propeller 62, causes rotation of the second propeller and shaft 60 in a second direction S opposite to the first direction F.

Thus, the single drive shaft 30 imparts counter rotational movement to the two propellers 40, 62.

Figure 6:
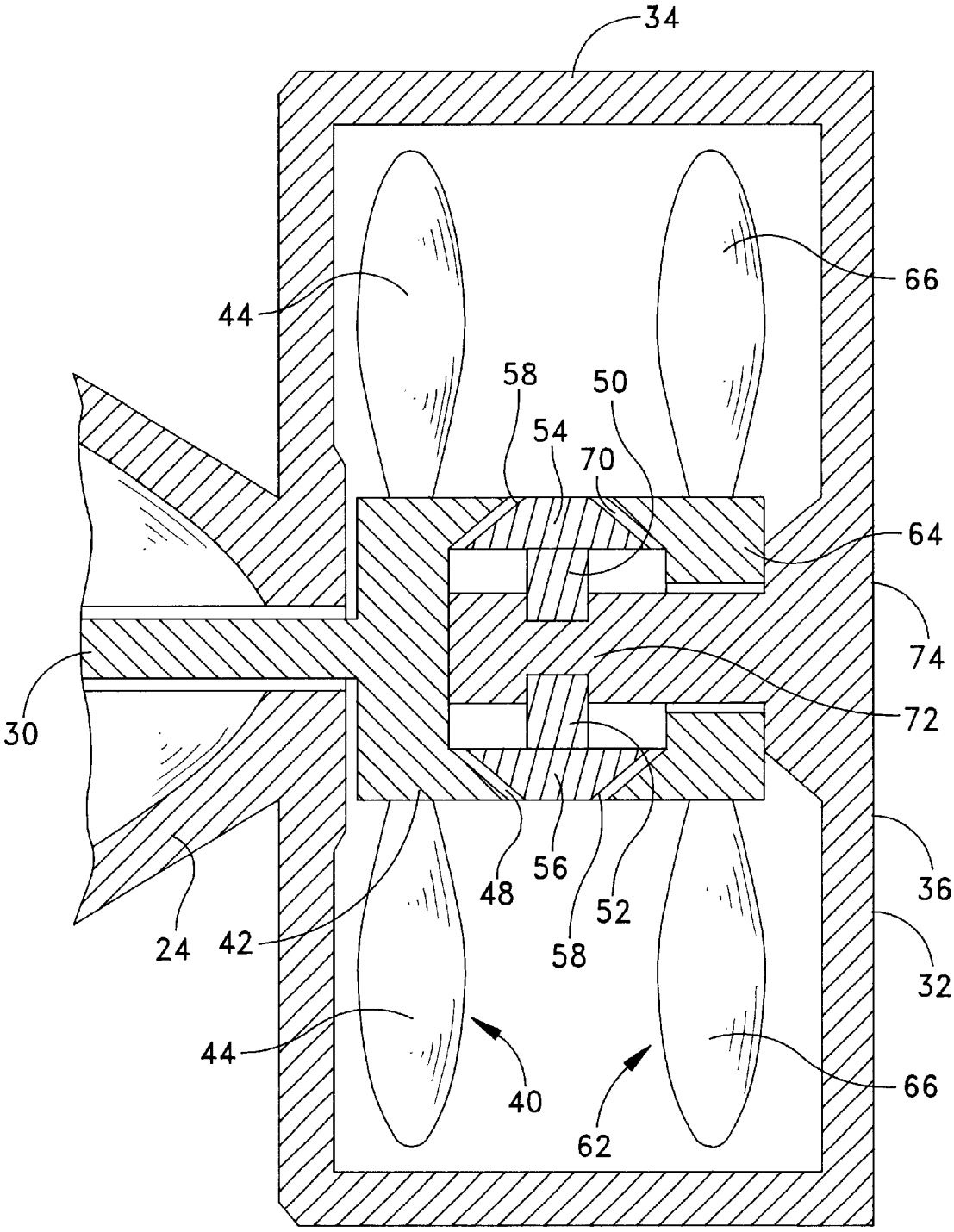
FIG. 6 is a diagrammatic illustration, in section, of an alternative embodiment of the invention.

Referring to FIG. 6, it will be seen that in an alternative embodiment, the gear teeth 48 of the first propeller 40 are disposed on the first propeller hub 42. The cage 32 includes an aft athwartships strut 36 comprising a support structure 74 from which extends a stationary central rod 72 in which the bevel gear spindles 50, 52 are rotatably mounted. The bevel gears 54, 56 are fixed on the outboard ends of the spindles 50, 52, respectively. The bevel gear single arrays of teeth 58 are complementary to, and engaged with, the first propeller gear teeth 48. The second propeller hub 64 is rotatably mounted on the rod 72 and the gear teeth 70 thereof are meshed with the gear teeth 58 of bevel gears 54, 56.

In operation, the rotational movement of the first propeller 40 is transmitted, through the bevel gears 54, 56, to the second propeller 62 which turns in a direction opposite, or counter, to the direction in which the first propeller 40 turns.

Thus, as in the above-described first embodiment, the alternative embodiment features a single drive shaft 30 for imparting counter rotational movement to two propellers 40,62.

It will be understood that many additional changes in the details, materials, steps and arrangement of parts, which have been herein described and illustrated in order to explain the nature of the invention, may be made by those skilled in the art within the principles and scope of the invention as expressed in the appended claims.

What is claimed is:

1. A marine propulsion assembly comprising:

a drive shaft;

a first propeller fixed to said drive shaft and turnable therewith in a first direction, said first propeller having a hub, propeller blades fixed to said hub, and an annular ring fixed to outboard tips of said blades;

a first annular array of gear teeth disposed on said first propeller annular ring and turnable therewith;

a second propeller aligned with said first propeller having a hub, propeller blades fixed to said second propeller hub, and an annular ring fixed to outboard tips of said second propeller blades;

a second annular array of gear teeth disposed on said second propeller annular ring;

bevel gears disposed between said first and second propellers, each of said bevel gears having one array of teeth engaged with said first and second annular arrays of gear teeth, said bevel gears transmitting rotation of said drive shaft and said first propeller to said second propeller, such that said second propeller turns in an opposite direction relative to said first propeller;

a cage in which said first propeller is disposed, said bevel gears being rotatable mounted in said cage; and a second shaft rotatably disposed at one end in said first propeller hub and at a second end in said cage, said second propeller hub being fixed to said second shaft.

2. The marine propulsion assembly in accordance with claim 1 said cage comprises a network of struts and said second shaft rotatably disposed in said cage is rotatably disposed in one of said struts.

3. The marine propulsion assembly in accordance with claim 2 wherein said network of struts includes fore and aft struts and athwartships struts, said second shaft rotatably disposed in one of said struts being disposed in an athwartships strut, and said bevel gears each being fixed to a spindle rotatably mounted on one of said fore and aft struts.

* * * * *